United States Patent [19]

Leemans

[11] Patent Number: 4,716,835

[45] Date of Patent: Jan. 5, 1988

[54] DISINTEGRATING PROJECTILE FOR CARTRIDGED MANEUVER AMMUNITION

[75] Inventor: Johan S. Leemans, Rosmalen, Netherlands

[73] Assignee: NWM de Kruithoorn B.V., Poeldonkweg, 'sHertogenbosch, Netherlands

[21] Appl. No.: 51,632

[22] Filed: May 20, 1987

[30] Foreign Application Priority Data

May 23, 1986 [DE] Fed. Rep. of Germany ..... 3617460

[51] Int. Cl.[4] ..... F42B 9/20

[52] U.S. Cl. ..... 102/529; 102/501; 102/517

[58] Field of Search ..... 102/444, 498, 501, 517, 102/529, 502, 506

[56] References Cited

U.S. PATENT DOCUMENTS

| | | | |
|---|---|---|---|
| 3,338,167 | 8/1967 | Jungermann et al. | 102/529 |
| 3,435,769 | 4/1969 | Germershausen | 102/529 |
| 3,916,795 | 11/1975 | Lemstra | 102/529 |

FOREIGN PATENT DOCUMENTS

| | | | |
|---|---|---|---|
| 1239961 | 5/1960 | Fed. Rep. of Germany . | |
| 1157555 | 7/1969 | United Kingdom | 102/529 |

*Primary Examiner*—Harold J. Tudor
*Attorney, Agent, or Firm*—Spencer & Frank

[57] ABSTRACT

A disintegrating projectile for cartridged maneuver ammunition for an automatic weapon. The projectile includes a thin-walled and closed body of plastic-like material. The body includes a circularly cylindrical section which changes into a tapering hollow tip. A rotationally symmetrical, stiffening, one-piece plastic insert, is adapted to the inner wall of the hollow tip and extends longitudinally of the projectile between a rear circular delimitation and a front circular limitation. The insert has the shape of two cups and includes a circular disc serving as a common bottom of the cups which are arranged one behind the other in the longitudinal direction of the projectile. The rear cup has a side wall thickness that constantly increases from the rear circular delimitation to the adjacent face of the circular disc member and the front cup has a side wall thickness that constantly increases from the front circular delimitation to the adjacent face of the circular disc member. The inner surface of the rear cup lies against the frontal face of a pressed body of metal powder. The projectile includes a hard elastic foam filling the area delimited by the inner surface of the front cup and the adjacent inner wall area at the frontal region of the projectile body.

6 Claims, 1 Drawing Figure

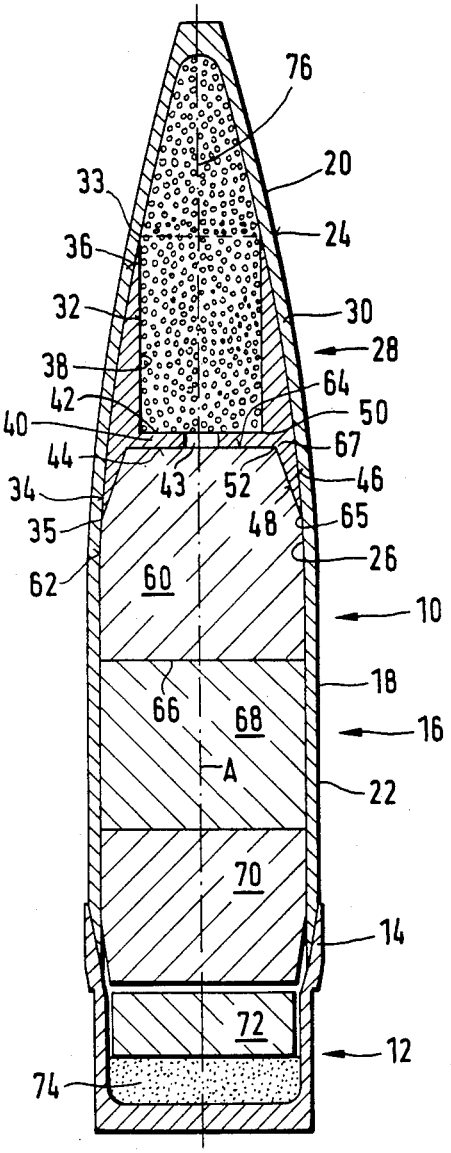
76
20
33
24
36
30
32
28
38
64
42
50
40
67
44
46
43
52
34
48
65
35
26
62
60
10
18
66
68
16
A
22
70
14
72
12
74

DISINTEGRATING PROJECTILE FOR CARTRIDGED MANEUVER AMMUNITION

BACKGROUND OF THE INVENTION

The present invention relates to a disintegrating projectile for cartridged maneuver ammunition for an automatic weapon in which the projectile incudes a thin-walled and closed body of plastic-like material having a cup-shaped bottom section and a main section connected therewith. The main section includes a circularly cylindrical section which changes into a tapering hollow tip in its frontal region and tightly encloses a given number of axially successively arranged, rotationally symmetrical pressed bodies of metal powder. A rotationally symmetrical stiffening insert made of plastic is disposed in the frontal region of the main section, is composed of two cup sections each open at one end, and presents a circular disc member oriented transverse to the longitudinal axis of the projectile. The rear face of the circular disc and the inner face of the side wall of one of the cup sections are in immediate contact with one of the bodies of pressed metal powder.

A disintegrating projectile of this type is disclosed in German Patent No. 1,239,961. The stiffening insert is composed of two thin-walled, unilaterally closed circular cylinders, with the inner diameter of the one cylinder being adapted to the outer diameter of the other so that the one cylinder can be placed in the other. A circularly cylindrical space of this type, closed on all sides, contains a pressed body of metal powder. The circular disc shaped bottoms are provided with radial recesses as desired break points.

The prior art disintegrating projectile is sufficiently resistant to the transverse forces generated during introduction (for example in a box for ammunition belts or in a belt supplier). However, in a weapon having a wedge-type breech block and two axially displaceable ejectors in the region of the chamber, malfunctions occur as the result of insertion conditions: namely, if the cartridge axis is flush with the bore axis during insertion of the cartridge, the gripper member of the rammer will be unable to push it to introduce it into the gun barrel, and carry it along precisely in the center, i.e. in extension of its longitudinal axis, because this would involve the danger of inadvertent ignition of the propellant charge. If, however, the gripper engages the bottom of the propellant charge casing anywhere other than in the center, the cartridge tends to break out of the axial direction. With the high insertion velocity involved, this has the result that the ogival face of the projectile tip would hit one side of the rear wall region of the chamber. However, in the prior art automatic weapon, one of the two ejectors (for ejection of an empty propellant charge casing from the chamber) is disposed in that region.

With live ammunition, the projectile is sufficiently resistant and insensitive in the respective region of the ogival face; it slides along the claw of the ejector which projects toward the bore axis so that it does not impede the insertion process. Once the cartridge has been inserted and the ejector has performed a forward movement, the respective ejector claw lies against the frontal face of the bottom of the propellant charge casing.

When maneuver cartridges holding a disintegrating projectile of the type referred to above are fired, contact by the ejector claw in the region of the thin plastic casing in the ogival region can cause a break in the projectile body. The claw may hook itself in the projectile body and consequently the ejector will not come to lie behind the bottom of the propellant charge casing but will instead be prematurely carried along by the damaged projectile body, interrupting the insertion process and thus leading to malfunction of the weapon. If the claw does not hook into the projectile body but rather tears the projectile body then slides off of it, a piece of the projectile body may be torn off on one side and be pulled backward so that it increases the diameter of the projectile in that region by the thickness of the body wall. Although this need not always result in an immediate malfunction of the weapon, metal powder may escape from the leak and may cause considerable wear of the gun barrel and thus result in premature inoperability of the weapon.

SUMMARY OF THE INVENTION

It is an object of the present invention to provide a disintegrating projectile of the same type described above, whose body, on the one hand, is sufficiently resistant in the ogival region and, on the other hand, does not produce dangerous broken pieces which could exceed safety limits ahead of the muzzle.

The above and other objects are accomplished in the context of a disintegrating projectile of the type first described above wherein, according to the invention:

the stiffening insert is made of one piece and extends longitudinally of the projectile between a rear circular delimitation and a front circular delimitation, each delimitation essentially corresponding to a respective circularly cylindrical region of the main section, the circular disc member of the insert having opposite faces oriented transverse to the longitudinal axis of the projectile and forming a common bottom of the two cups which are arranged, one behind the other, in the longitudinal direction of the projectile;

the rear cup has a side wall thickness that constantly increases from the rear circular delimitation to the face of the circular disc member adjacent to the rear circular delimitation;

the front cup has a sidewall thickness that constantly increases from the front circular delimitation to the face of the circular disc member adjacent to the front circular delimitation;

the upper pressed body has a frontal face and the rear cup has an inner surface which lies against such frontal face; and the front cup has an inner surface and the main section has an inner wall area in its frontal region adjacent to the inner surface of the front cup, and the projectile includes a hard plastic foam filling the area delimited by the inner surface of the front cup and the adjacent inner wall area of the main section.

BRIEF DESCRIPTION OF THE DRAWINGS

The invention will be described in greater detail below with reference to the accompanying sole drawing FIG. which shows a longitudinal sectional view of a preferred embodiment of a disintegrating projectile according to the invention.

DESCRIPTION OF THE PREFERRED EMBODIMENT

Referring to the FIG., there is shown a thin-walled body 10 of plastic or the like which includes a cup-shaped bottom section 12 and a main section 16. Section 16 comprises a circularly cylindrical section 18 followed at the front by a hollow tip 20. Bottom section 12 and main section 16 are connected with one another in a region 14 in a known manner. Section 18 has a circumferential face 22 followed at the front by a tapered transition region 28 which presents an outer face 24 of hollow tip 20. An inner wall face 26 of body 10 encloses an interior space (not identified in detail) composed of, in succession, a rearward buffer 74 of metal powder, followed by rotationally symmetrical pressed bodies 70, 68 and 60 of metal powder.

The circumferences of pressed bodies 70 and 68 are tightly surrounded by inner wall face 26. This is only partially the case for front pressed body 60, which has a frustoconical frontal face region 64 of which only the largest circumferential circle 65 lies on inner wall face 26.

A stiffening insert 30 made of plastic or the like extends from circumferential circle 65 in the direction toward hollow tip 20. The insert includes a front cup 32 and a rear cup 34 and is delimited by a circular edge 33 at the front and a circular edge 35 at the rear. An outer wall face 36 of front cup 32 and an outer wall face 46 of rear cup 34 steadily change into one another and are in intimate contact with inner wall face 26. A circular disc member 40 connects cups 32 and 34, but does not separate their interiors (not identified). The interior of front cup 32 is delimited by circular edge 33, a circularly cylindrical inner face 38 and a frontal face 42 of circular disc member 40 and is open at the front. Since circular edge 33 also lies on inner wall face 26, the wall thickness of the front cup steadily increases toward face 42. The wall thickness of rear cup 34 steadily increases from circular edge 35, which coincides with circumferential circle 65, to a throat 52 of inner face 48. Cup 34 is further delimited by the area 44 of circular disc section 40, and throat 52 coincides with the smallest circumferential circle 67 of frontal face region 64.

The area defined by inner face 38 and face 42 is supplemented beyond the front delimitation 33 by an area delimited by inner wall face 26 in the region of hollow tip 20. This area is filled with a body composed of a low density hard elastic foam 76.

If during insertion, the outer face 24 of the disintegrating projectile according to the invention meets with an obstacle as represented by the above-mentioned ejector claw, a strong pressure is exerted in succession onto a narrow strip on the exterior of body 10. However, body 10 in hollow tip region 20 is able to yield and is only dented inwardly. This denting movement is initially counteracted by the hard foam 76 and is then increasingly counteracted by the wall of front cup 32. This effect increases with approach to the region of greatest wall thickness in the vicinity of the circular disc member 40 and a transition occurs to circular edge 35. Since the annoying contact between disintegrating projectile and ejector claw regularly takes place within narrow confines, it remains without damaging consequences. After leaving the gun barrel, the spinning movement of the projectile tears open body 10 at the conventional desired break points. The configuration and low average density of the broken piece, which is composed of insert 30 and hard foam body 76, result in its rapid deceleration so that no danger exists within close limits.

If a suitable material is selected, for example polyurethane, the hard foam 76 can advantageously be incorporated in insert 30 to form a single integrated piece. If necessary, in order to reduce the mass of the projectile, or for manufacturing reasons, a centered axial bore 43 may be provided which extends at least through circular disc member 40.

The present disclosure relates to the subject matter disclosed in German P No. 36 17 460.2-15 of May 23rd, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a disintegrating projectile for cartridged maneuver ammunition for an automatic weapon, the projectile including: a thin-walled and closed body of plastic-like material including a cup-shaped bottom section and a main section connected with the bottom section, the main section including a circularly cylindrical section having a frontal region and which changes into a tapering hollow tip in such frontal region, the main section tightly enclosing a given number of axially successively arranged, rotationally symmetrical pressed bodies of metal powder; and a rotationally symmetrical stiffening insert made of plastic, disposed in the frontal region of the main section and composed of two cup sections each open at one end, the insert presenting a circular disc member with a rearwardly directed face oriented transverse to the longitudinal axis of the projectile, one of the two cup sections having a side wall with an inner face, wherein such inner face and the rearwardly directed face of the insert are in immediate contact with metal powder of one of the pressed bodies, the improvement wherein:

said insert is made of one piece and extends longitudinally of said projectile between a rear circular delimitation and a front circular delimitation, each said delimitation essentially corresponding to a respective circularly cylindrical region of said main section, said circular disc member of said insert having opposite faces oriented transverse to the longitudinal axis of the projectile and forming a common bottom of said two cups which are arranged one behind the other in the longitudinal direction of said projectile and constitute a front cup and a rear cup, respectively;

said rear cup has a side wall thickness that constantly increases from the rear circular delimitation to the face of said circular disc member adjacent to said rear circular delimitation;

said front cup has a side wall thickness that constantly increases from the front circular delimitation to the face of said circular disc member adjacent to said front circular delimitation;

the upper pressed body has a frontal face and the inner surface of said rear cup lies against the frontal face of said upper pressed body; and said main section has an inner wall area in its frontal region adjacent to the inner surface of said front cup, and said projectile includes a hard elastic foam filling the area delimited by the inner surface of said front cup and said adjacent inner wall area of said main section.

2. Disintegrating projectile as defined in claim 1, wherein at least said rear circular delimitation is essentially configured as a circular edge of said insert.

3. Disintegrating projectile as defined in claim 1, wherein the inner surface of said front cup delimits a circular cylinder.

4. Disintegrating projectile as defined in claim 1, wherein said front circular delimitation is configured as a circular edge of said insert.

5. Disintegrating projectile as defined in claim 1, wherein said hard foam forms an integrated unit with said insert.

6. Disintegrating projectile as defined in claim 1, including a centered axial bore which extends at least through said circular disc member.

* * * * *